United States Patent [19]

Chebowski

[11] Patent Number: 4,713,509

[45] Date of Patent: Dec. 15, 1987

[54] PALM SWITCH ACTUATOR AND LATCH

[75] Inventor: Jerome E. Chebowski, Fremont, Ind.

[73] Assignee: Rees, Inc., Fremont, Ind.

[21] Appl. No.: 916,899

[22] Filed: Oct. 8, 1986

[51] Int. Cl.[4] ..... H01H 9/28

[52] U.S. Cl. ..... 200/328; 200/333; 200/334; 200/43.18

[58] Field of Search ..... 200/43.01, 43.16, 43.17, 200/43.18, 43.19, 43.21, 43.22, 333, 334, 157, 318, 319, 320, 321, 322, 323, 324, 325, 328, 327, 330, 332, 340; 74/527, 529, 532

[56] References Cited

U.S. PATENT DOCUMENTS

| | | | |
|---|---|---|---|
| 2,097,294 | 10/1937 | Lang | 200/322 X |
| 2,829,537 | 4/1958 | Mall et al. | 74/532 |
| 3,873,796 | 3/1975 | Worobec, Jr. | 200/157 |
| 4,180,716 | 12/1979 | Suzuki | 200/320 |
| 4,504,707 | 3/1985 | Ochiai | 200/43.18 |
| 4,584,899 | 4/1986 | Old et al. | 74/532 |
| 4,590,345 | 5/1986 | Marshell | 200/43.16 |

FOREIGN PATENT DOCUMENTS

| | | | |
|---|---|---|---|
| 2903146 | 8/1980 | Fed. Rep. of Germany | 200/328 |

OTHER PUBLICATIONS

"A Study of Palm Switches at AC Spark Plug", by Sanford Pincus, 8–18, 1983.

*Primary Examiner*—Henry J. Recla
*Assistant Examiner*—Ernest G. Cusick
*Attorney, Agent, or Firm*—Harness, Dickey & Pierce

[57] ABSTRACT

A combination actuator and guard for palm switches of the type conventionally used to initiate the cycle operation of hydraulic presses and like machines comprising a hand-lever pivotally mounted on a frame that is adapted for mounting on the machine at the cycle control switch position with the lever superimposed on the palm switch and including a slidable latch member on the hand-lever normally spring-loaded to engage stop means on the frame to prevent operation of the hand-lever to actuate the switch but moveable by an actuator at the pivoted edge of the hand-lever to release the stop means and permit manipulation of the hand-lever to actuate the palm switch and initiate the machine cycle.

26 Claims, 5 Drawing Figures

PALM SWITCH ACTUATOR AND LATCH

STATEMENT OF THE INVENTION

This invention relates to new and useful improvements in palm switch actuators and guards therefor.

BACKGROUND OF THE INVENTION

Palm switches conventionally are connected in the control circuits of machines such as hydraulic presses and the like and are closed manually by the machine operator to start the machine cycle.

There may be and frequently are switches mounted directly on the machine but more often they are carried by a "run bar" that in turn may be mounted either on the machine or on a pedestal that can be moved from one location to another as required. In any case, the palm switch is actuated manually by the machine operator who closes it to start the machine cycle by striking or pressing the mushroom-shaped head of the switch-actuator usually with the palm of his hand. In order to prevent inadvertent actuation of the switch, several pounds pressure normally are required to actuate it. Some of these switches respond to relatively light pressure and can be actuated by the fingers alone, but others are more difficult to depress and may require as much as twelve pounds of force to bottom out.

As a practical matter, palm switches are used literally in hundreds of applications. In some instances, only one palm switch is used to start the machine cycle. In other applications, dual palm switches are used; and, in these instances, it is necessary for the machine operator to close both switches in order to begin the machine cycle. For the most part, palm switches are hit quickly and then released; but sometimes it may be necessary for the operator to hold the switch closed during the entire cycle time of the machine. In practice palm switches are placed in seemingly random fashion and there is no consistent standard for their location on or near the machine. They may be placed high or low; and dual switches may be placed far apart or close together. Some switches require a lateral motion of the hand to close them; whereas other switches require a forward motion of the hand. While palm switches ideally are located at or near waist level, it sometimes is necessary for the machine operator to reach above his head or far to one side to operate the switch, or it may be necessary for the operator to reach far to one's side in order to close the switch. Many machine operators are required to wear heavy gloves to protect their hands during operation of the machine; and many of the button guards conventionally used interfere with gloved hand operation of the switch.

In many instances, guards of various kinds are mounted in association with the palm switch to prevent inadvertent operation of the switch by the operator or by a foreign object falling across the switch button. Accidental operation of the machine, of course can be dangerous to the operator as well as to the machine.

Many of the circumstances and conditions referred to above contribute significantly to operator fatigue, and this in turn sometimes results in physical injury to the operator. Moreover, it is not unusual for the operators to have to actuate the palm switch as many as five thousand times a day and the almost constant impact of the operators hand on the switch results in physical trauma and injury to the hand. The mushroom head of the switch actuator conventionally has a diameter of only two to three inches so that the force required to actuate the switch is concentrated on a relatively small area of the hand. In fact, manipulation of the switches is a leading contributor to hand and wrist trauma among machine operators; and, accordingly hand injuries are the most prevalent cause of worker compensation payments. According to a recent study, palm switch related injuries rank third in prevalence of all musculoskeletal problems. Some of the disorders that result from the continual manual pounding of improperly designed palm buttons are carpal tunnel-syndrome, tenosynovitis, and gaglionic cysts. At the end of a work shift, many operators experience tingling sensations in their hands and numbness in their fingers. Frequently, also, many operators who are required to reach for controls that are above waist height are subjected to biomechanical conditions that impose stress on the back. Electromyography (EMG) studies have demonstrated that the extensor carpi radialis (wrist extensors) and the flexor digitorum profundus (finger flextors) experience a high susceptibility to strains and sprains.

SUMMARY OF THE INVENTION

From the foregoing it will be readily apparent that there is a need in the art for a palm switch actuator and guard that is readily adaptable to any of a large number of standard palm switch mountings and locations and that minimizes the physical effort required to operate the switch and consequently operator fatigue and the possibility of physical injury to the operator resulting from continual and repeated operation of the switch over an extended period of time. The present invention satisfies this need.

The palm switch actuator and guard of this invention has a uniquely formed supporting frame that can be readily mounted at the switch position on many different types of machines. More particularly, the frame has a central opening through which the switch actuator extends; and it has upstanding parallel side flanges that are disposed in in embracing relation to the switch button or actuator. A large hand-lever that engages and conforms at least generally to the entire surface at the operator's palm so that it dissipates rather than concentrates the operating force on the operator's hand is disposed between and pivotally attached to the flanges of the supporting frame and arranged to overlay the palm switch button. Moreover, the pivot connection between the hand-lever and the supporting frame is located adjacent one edge of the lever and laterally of the palm switch button so that manual pressure against the hand-lever is multiplied by a leverage factor against the palm switch button in closing the cycle start switch of the machine. The construction and conformation of the hand-lever provides a convex top surface that conforms generally to the palm of the hand when the latter is placed thereon with the fingers extending beyond the pivot axis about which the lever turns. The hand-lever is at least as large as the normal size of an operator's hand, so that the entire or substantially the entire palm rest upon the lever in use.

As a precautionary measure, a latch member is mounted for sliding movement on the underside of the hand-lever; and the latch member is spring actuated to the limit of its travel in one direction to a position where it rests on and is supported by stops that prevent the lever from accidentally actuating the switch.

As a further feature of the invention, the latch member is provided with a latch actuator member that is disposed parallel to and normally outwardly from the pivoted edge of the hand-lever for convenient engagement with and actuation by the fingers of the operator's hand when the latter is placed on the hand-lever in the manner described above. Thus, the latch actuator member is co-active with the latch member and is operated by a simple contraction of the fingers when the operator places his hand on the hand-lever to move the latch actuator against the action of the spring means that normally holds it in the stop engaging position and to disengage the latch member from the stop means and simultaneously to permit the hand-lever to move against and to actuate the palm switch button and close the palm switch to cycle the machine.

As still a further feature of the invention, the side flanges of the supporting frame to which the hand-lever is pivotally attached are spaced sufficiently apart to readily accommodate the hand of the operator and to allow for easy access of large gloved hands since gloves are required to be worn on many jobs. Also, the side flanges extend sufficiently above the hand-lever to serve as guards for the latter. As such, they prevent foreign objects from falling across and actuating the hand-lever and thereby closing the switch and operating the machine accidentally or through inadvertence.

From the foregoing, it will be readily apparent that dual guarding of the cycle start switch of the machine is achieved in part by the high frame side flanges and in part by the latch member that is releasably held in the stop engaging position to prevent inadvertent manual actuation of the hand-lever and accidental operation of the cycle control switch of the machine. At the same time, the latch member, which is spring loaded through the latch actuator, is readily disengageable from the stops by the operator's fingers when the hand is placed naturally on the hand-lever.

Finally, the relatively simple construction of the switch guard assures reliable operation and a long life therefor. There are only two moving parts in the device and they are subject to relatively little wear in use. The supporting frame preferably is made of heavy gauge steel plate and the hand-lever preferable is made of high impact plastic. By reason of its relatively simple construction, the supporting frame is adapted for universal mounting that allows for field installation on many different kinds of machines and ready adaptability to many different kinds and styles of control switches that are produced by different manufacturers. The large hand-lever accommodates all size hands, whether gloved or not; and the lever is sufficiently large enough to reduce the switch operating force by 50 percent or more thus minimizing and, in many instances, eliminating physical trauma and injury to the operator's hands, wrists and arms. The switch actuator/guard of this invention is an "add-on" device so that the guarded switch is not altered in form or function by addition of the device. Operator fatigue is minimized by the reduced operating force and because the area of contact between the hand and the hand-lever is increased approximately 500 percent compared with the area of hand contact provided by the standard actuating button of conventional machine control switches. The finger tip operation of the spring-loaded latch actuator and the latter's position relative to the hand-lever assures that the operator's hands are in the proper area for easy release of the latch member during operation of the machine control switch. The actuator/guard of this invention is easily installed and maintained and the manner in which it is mounted on the machine and the way in which it is associated with the cycle start switch of the machine assures the integrity of the machine's electrical circuits even though the actuator guard is accidentally destroyed or intentionally dismantled from the machine.

DESCRIPTION OF THE PREFERRED EMBODIMENT

Figure 1:
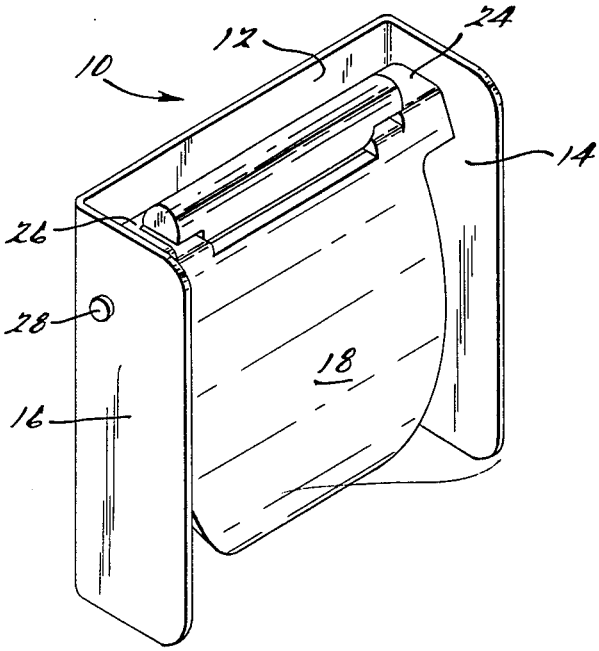
FIG. 1 is a perspective view of a switch actuator/-guard embodying the present invention.

In the drawing, wherein for the purpose of illustration, is shown a preferred embodiment of the invention, the numeral 10 designates the supporting frame of the actuator/guard. The frame 10 is generally U-shaped in transverse section. The middle or bight portion 12 of the frame 10 is flat and relatively wide and side flanges 14 and 16 are bent upwardly at right angles thereto at opposites sides thereof. In the particular form of the invention here shown by way of illustration, the middle frame portion 12 is substantially square in plan and the under surface of the middle frame portion 12 defines a mounting surface for the frame.

A hand-lever, designated generally by the numeral 18, is disposed between the two side flanges 14 and 16 and spaced above the middle section 12 of the supporting frame 10. As perhaps best shown in FIGS. 3 and 4, the top surface 20 of the hand-lever 18 is convexly curved and shaped to conform at least generally to the palm of a hand placed thereon with the fingers extending beyond the edge 22 thereof. As suggested, the hand-lever 18 preferably is made of high impact plastic so as to be strong, tough and durable. Adjacent to the edge 22, the lever 18 is formed at opposites thereof with laterally spaced, depending mounting lugs 24 and 26 that extend away from the top surface 20 and fit snugly but movably between the frame flanges 14 and 16. Aligned pivots 28 and 30 carried by the flanges 14 and 16 are journaled in the lugs 24 and 26 to permit free swinging movement of the hand-lever 18 about the pivot axes.

As stated previously, the frame 10 is adapted to be mounted on a machine or on the run-bar of the machine with the actuator button of the palm or cycle-short switch extending through an opening 32 that is of sufficient size to accommodate all or substantially all conventional machine cycle-start switches.

Figure 2:
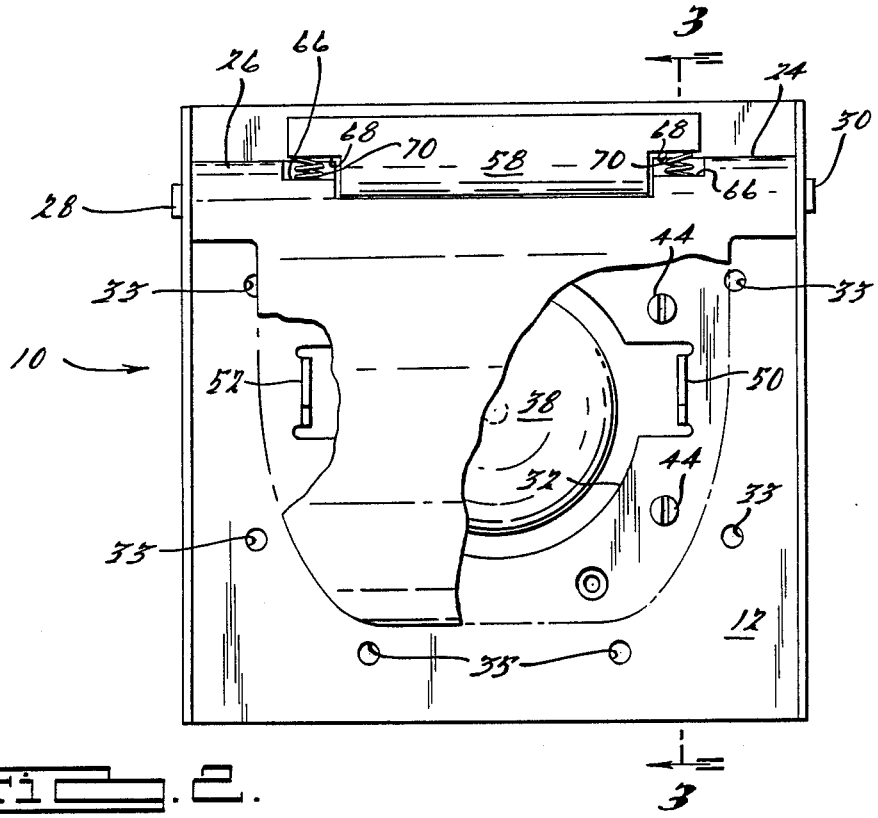
FIG. 2 is an enlarged, top plan view of the actuator/-guard showing parts broken away for clearness of illustration.

In practice, the opening 32 is disposed substantially centrally of the middle frame portion 12. To this end, the middle portion of the frame 10 is formed with four mounting holes 33 suitably arranged and spaced to coincide with threaded mounting holes conventionally provided in the switch panels of machines of the type involved here. Four such holes 33 are shown in FIG. 2. Additional mounting holes 35 provided in the middle frame portion 12 assures essentially universal mounting and allows for field installation on many different styles of switches produced by different switch manufacturers. Thus, the opening 32 accepts the palm switch of the machine and comprises an adaptor means that cooperates with the palm switch to position the palm switch in operative association with the hand-lever 18 when the actuator/guard of this invention is mounted on the machine. Cycle-start switches of the type involved here are well known in the art and, since they comprise no part of the present invention, a detailed description of the switch is not necessary for a full and complete understanding of this invention. Suffice it to say that switches of the type involved here conventionally are contained in a metal or formed plastic housing, a fragmentary portion of which is here shown at 34. The switch housing 34 here shown is provided with an upstanding embossment 36; and the switch actuator 38, sometimes referred to as a "mushroom" or "switch button" is mounted in the embossment 36 to open or close the switch mechanism contained in the housing 34. A sealing ring 40 surmounting the embossment 36 surrounds the stem 42 of the switch actuating head or button 38 and prevents dirts and other foreign matter in the vicinity of the switch from entering the housing 34.

Cycle start switches of the type involved here normally are open and the switch is closed to initiate an operating cycle of the machine by depressing the mushroom-shaped switch button 38. These so-called switch buttons conventionally are three inches in diameter or less and they normally are operated directly by the hand of the operator in the matter herein above described. The operator normally places his hand on the top of the switch button 38 and depresses the latter to close the switch. It is the shape of the switch button 38 and its relatively small size that causes the physical trauma to the hand, wrist and arm of the machine operator previously referred to. Cycle start switches of the type involved here normally are spring-loaded to the open position; and the actuator button 38 is depressed manually against the spring action. Conventionally, approximately five pounds or less pressure is required to fully depress the actuator button 38 sufficiently to assure closure of the switch; although, in practice, the amount of force varies and it may be as much as twelve pounds. The actuator/guard of this invention is adapted to be mounted on the machine with the middle section of the supporting frame attached to both the switch panel as previously described and to the switch housing 34. When the actuator/guard of this invention is so mounted, the embossment 36 extends through the center opening 32 and is connected to the frame 10 by screws 44.

When the actuator guard is mounted in the manner described, the hand-lever 18 rests on the switch actuator button 38. When the hand-lever 18 is parallel to the middle section 12 of the supporting frame 10 as it normally is (FIG. 3) the switch button 38 is seated in an annular ring 46 formed on the underside of the hand-lever to assure solid seating of the hand-lever on the switch actuator 38. In use the hand-lever 18 is pivoted from the position shown in FIG. 3 to the position shown in FIG. 4 to depress the switch actuator 38 and to close the cycle start switch of the machine; and in order to permit this action to occur smoothly, the top surface of the switch button 38 is spherically curved so that the edge of the ring 46 slides on the surface of the button as required to accommodate the closing movement of the switch actuator 38.

Figure 5:
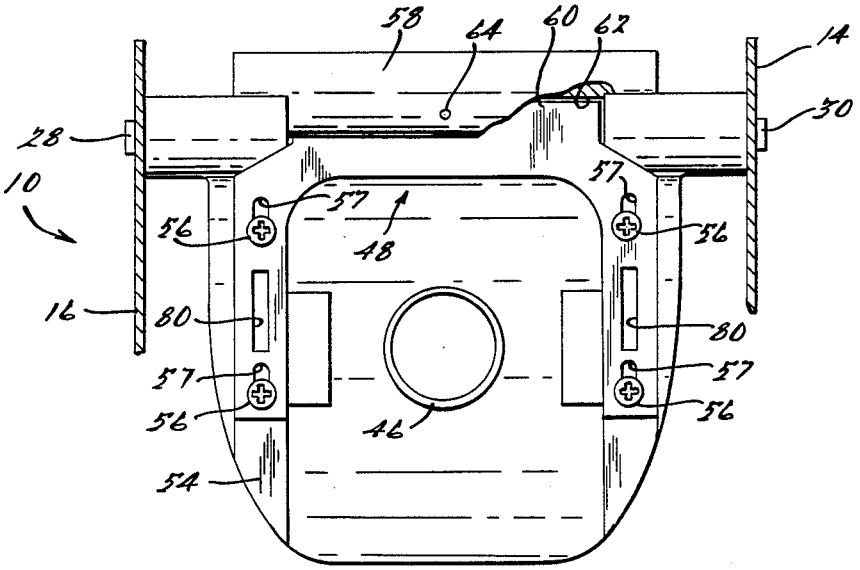
FIG. 5 is a bottom plan view of the hand-lever assembly and showing fragmentary portions of the frame flanges in cross-section.

In order to prevent movement of the hand-lever 18 inadvertently or accidentally to close the cycle start switch of the machine, the hand lever is provided on the undersurface thereof with a latch member 48. The latter normally resets on and is supported by a pair of stop members 50 and 52 that are provided on the supporting frame 10 at opposite sides of the center opening 32, as perhaps best shown FIG. 2. In the form of the invention here shown, the stop members 50 and 52 are formed integrally with the middle portion 12 of the supporting frame 10. In practice, the opening 32 is formed by a conventional stamping and forming operation and the stop members 50 and 52 are struck and bent at right angles from the plane of the middle portion 12 at the same time that the opening 32 is formed. Also, in the form of the invention here shown, the latch member 48 is U-shaped; and is supported on the flat under surface of a similarly shaped flange 54 that is formed integrally with and extends downwardly from the hand lever 18. As perhaps best shown in FIG. 5, the flange 54 is of substantially the same size and shape as the latch member 48; and both the latch member and its supporting flange are disposed with the bight or middle portions thereof adjacent to the pivoted edge of the hand-lever 18 and the two arm portions thereof extending forwardly or away from the pivoted edge of the hand-lever. Fastening screws 56 extend through elongated slots 57 in the arm portions of the latch member 48 and into tapped holes (not shown) in the supporting flange 54. In practice, the overlapping heads of the screws 56 hold the latch member securely but slidably on the flange 54 within limits defined by the slots 57. The latch member 48 is moved forwardly on the hand-lever 18 by a latch actuator bar 58 disposed behind and parallel to the pivoted edge of the hand lever 18. In the form of the invention here shown by way of illustration, the latch member 48 is formed at the rearward edge thereof with a rearwardly projecting flange 60 that extends into and snugly fits a longitudinal slot 62 in the actuator bar 58. A set screw 64 holds the actuator bar 58 (attached securely to the latch member 48. The hand lever lugs 24 and 26 and the slide actuator bar 58 are formed with confronting interfitting recesses 66 and 68 that accommodate compression springs 70 the terminal portions of which are seated in and confined by sockets 72 and 74 in the lugs 24 and 26 and the actuator bar 58, respectively.

Figure 3:
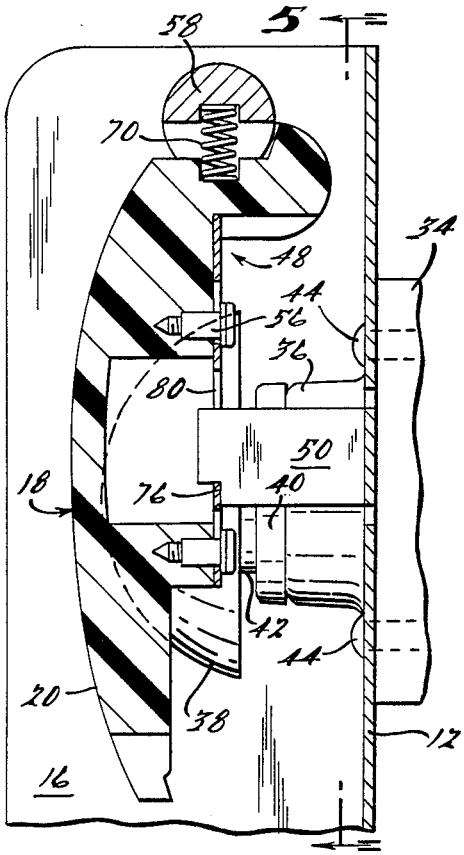
FIG. 3 is a vertical sectional view taken on the line 3—3 of FIG. 2 and showing the latch member in the stop engaging position.
Figure 4:
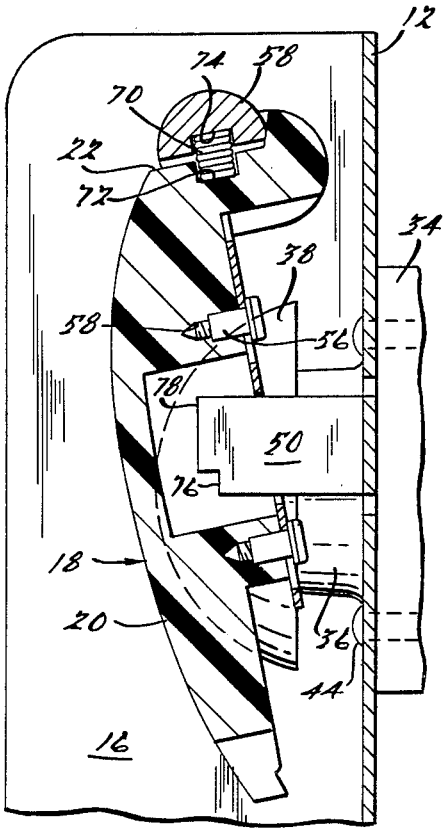
FIG. 4 is a vertical sectional view similar to FIG. 3 but showing the latch member released from the stops and the hand-lever in the switch operating position.

In the normal raised position of the hand lever 18, shown in FIG. 3, the arm portions of the latch member rest on upwardly facing shoulders or seats 76 formed on the stop members 50 and 52 at the forward edges thereof and the portions 78 of the stop members behind the seats 76 extend upwardly through longitudinal ways in the form of elongate slots 80 provided in the arm portions of the latch member 48 intermediate the slots 57. When the latch member 48 is held in the rearward position by the springs 70, the latch member rests on the seats 76 and the latter support and hold the hand-lever in the raised position shown in FIG. 3 and positively prevent the hand-lever from being depressed, and this in turn prevents inadventent actuation of the hand-lever to depress the switch actuator 38 and closing of the cycle start switch of the machine. However, when the machine operator places his hand naturally on the hand-lever 18, the fingers extend beyond the pivot edge of the lever and curl around the actuator bar 58. Consequently, in order to depress the switch actuator 38 and initiate the machine cycle, it is merely necessary for the machine operator to contract his fingers. This action moves the actuator bar 58 and the latch member 48 forwardly against the resilient action of the springs 70 and causes the latch member to move off of the seats 76. This action, in turn, disengages the latch member 48 from the stop members 50 and 52 and permits the hand-lever 18 to be pushed downwardly to depress the switch actuator 38 and close the cycle start switch. When the hand lever 18 is depressed in this manner the intermediate slots 80 move downwardly on the stop members 50 and 52, as shown in FIG. 4. As this action progresses, the stop members 50 and 52 and the slots 80 define guide means in the sense that they mechanically cooperate to guide the hand-lever and to resist any lateral pressure from the operators hand. This is an important consideration since the cycle time of these machines is short and machine operators frequently are required to wear gloves. These circumstances require frequent operation of the actuator guard and results in the operators motions to initiate operation of the machine being awkward and clumsy and contribute to a tendency on the part of the operator to strike the hand-lever with excessive force and sometimes to exert lateral as well as downward pressure on the hand-lever. Contrariwise, when the latch actuator bar 58 is released, the springs 70 immediately retract it and the latch member; and when the machine operator removes his hand from the hand-lever 18, the switch actuator 38, which is conventionally spring loaded to the raised position, immediately raises the hand-lever sufficiently so that the springs 70 can reseat the latch members on the stop members 50 and 52. This action positively prevents the hand-lever from again operating the cycle start switch until the sequence of events recited above is repeated.

While it will be apparent that the invention herein described is well calculated to achieve the benefits and advantages as hereinabove set forth, it will be appreciated that the invention is susceptible to modification, variation and change without departing from the spirit thereof.

I claim:

1. An actuator-guard for palm switch comprising a supporting frame having a mounting surface;

a hand-lever pivotally attached adjacent one edge thereof to said supporting frame;

fixed stop means;

latch means carried by said hand-lever movable between stop-engaging and stop-disengaging positions whereby to be selectively engageable with and disengageable from said stop means;

actuator means coactive with said latch means operable to move the latter from said stop-engaging position to said stop-disengaging position, said hand-lever being adapted to be manually pivotally actuated by placing the palm of the hand thereon with the fingers extending beyond said lever, and said actuator means being disposed adjacent to said edge of said hand-lever for convenient actuation thereof and of said latch means to release said latch means from said stop means whereby to permit release of said latch means from said stop means and simultaneous pivotal actuation of said hand-lever by a simple contractive movement of said fingers.

2. An actuator-guard for palm switches as defined by claim 1 wherein said supporting frame has upstanding support members at opposite sides of the said hand-lever, portions of said support members extending above said hand-lever and said extending portions forming guard means for preventing inadvertent actuation of said hand-lever.

3. An actuator-guard for palm switches as defined by claim 2, wherein said support members are in the form of flanges formed as integral parts of said supporting frame.

4. An actuator-guard for palm switches as defined by claim 3 wherein said flanges are disposed in close proximity to said hand-lever, and wherein said flanges extend longitudinally beyond said one edge of said hand-lever.

5. An actuator-guard for palm switches as defined by claim 3 wherein, said flanges are disposed in relatively close proximity to said hand-lever but are spaced sufficiently apart to accommodate a gloved hand of a machine operator, and wherein said flanges extending longitudinally beyond both said one edge and the edge of said hand-lever opposite said one edge of said hand-lever as well as above said hand lever whereby to guard against inadvertent actuation of said hand-lever.

6. An actuator-guard for palm switches as defined by claim 2, wherein said stop means are disposed at opposite sides of and underneath said hand-lever and are operative to support the latter from below.

7. An actuator-guard for palm switches as defined by claim 1 wherein said supporting frame has upstanding support members thereon at opposite sides of said hand-lever, and said support members extend above said hand-lever and form guard means for preventing foreign objects falling across said switch from inadvertently actuating said hand-lever.

8. An actuator-guard for palm switches as defined by claim 7 wherein said support members are in the form of flanges formed as integral parts of said supporting frame.

9. An actuator-guard for palm switches as defined by claim 8 wherein said flanges are disposed at opposite side of and in close proximity to said hand-lever and extend substantially at right angles to the mounting surface of said frame; and wherein said flanges extend longitudinally beyond said one edge of said hand-lever.

10. An actuator-guard for palm switches as defined by claim 8 wherein said flanges are disposed in relatively close proximity to said hand-lever but are spaced sufficiently apart to accommodate the hand of a machine operator there between; and wherein said flanges extend longitudinally beyond at least said one edge of said hand-lever, as well as above the hand-lever whereby to guard against inadvertent actuation of said hand-lever.

11. An actuator-guard for palm switches as defined by claim 1, wherein said actuator means is attached to and movable with said latch means and is disposed outboard of and adjacent to said edge of said hand-lever.

12. An actuator-guard for palm switches as defined by claim 1, including resilient means normally holding said latch means engaged with said stop means.

13. An actuator-guard for palm switches as defined by claim 1 wherein said stop means are disposed at opposite sides of said hand-lever for seating engagement with said latch means.

14. A palm switch actuator and guard comprising a supporting frame adapted for mounting on a machine such as an hydraulic press or the like at the palm or cycle control switch position of the machine;

a hand-lever;

pivot means adjacent one edge of said hand-lever connecting the hand-lever to said frame;

said hand-lever having a convex top surface shaped generally to conform to the palm of a hand placed thereon with the fingers extending beyond said one edge, said hand-lever being disposed to overlay and being pivotally actuatable from and against said palm switch to operate said palm switch to initiate a machine cycle;

fixed stop means;

latch means carried by said hand-lever and being selectively movable between stop-engaging and stop-disengaging positions and in said stop-engaging position said latch means being engageable with said stop means to prevent operation of said palm switch by said hand-lever, said latch means being operable to disengage said stop means to permit operation of said palm switch by said hand-lever; and resilient means coactive with said latch means to hold the latch means normally in the stop-engaging position to prevent operation of said palm switch and cycling of said machine by said hand-lever, said latch means including latch-actuator means disposed at said one edge of said hand-lever for engagement with and actuation by said fingers when the hand of a machine operator is placed on the hand-lever, said latch-actuator means being coactive with said latch means and operable by contraction of said fingers there against to move said latch means against the action of said resilient means to disengage said latch means from said stop means and simultaneously to permit said hand-lever to move against and to operate said palm switch to cycle said machine.

15. An actuator-guard for palm switches as defined by claim 14, wherein said supporting frame is provided with laterally spaced, upstanding flanges at opposite sides of said hand-lever; said hand-lever is pivotally attached to said flanges; and said stop means are disposed on said supporting frame at opposite sides of said palm switch position for supporting said hand-lever when said hand-lever is in the stop-engaging position.

16. A combination actuator-and-guard for palm switches of the type with which machines such as presses and the like conventionally are equipped to control the operating cycle of the machine comprising a frame adapted for mounting on said machine adjacent to said palm switch;

a hand-lever overlying at least part of said frame;

pivot means adjacent one edge of said hand-lever connecting the hand-lever to said frame, said hand-lever having a convex top surface shaped generally to conform to the palm of a hand placed thereon with the fingers extending beyond said one edge, said hand-lever being further disposed to overlie and being pivotally actuatable against said palm switch to operate the same to initiate a machine cycle;

fixed stop means;

latch means carried by said hand-lever selectively movable between stop-engaging and stop-disengaging positions and in the stop-disengaging position said latch means being engageable with said stop means to prevent operation of said palm switch by said hand-lever and in the stop-disengaging position said latch means being disengageable from said stop means to permit operation of said palm switch by said hand-lever; and resilient means coactive with said latch means to hold the latch means normally retracted in the stop-engaging position to prevent operation of said palm switch and cycling of said machine by said hand-lever, said latch means including latch-actuator means disposed at said one edge of said hand-lever for engagement with and actuation by said fingers when the hand of the machine operator is placed on the hand-lever, said latch-actuator means being coactive with said latch means and operative by contraction of said fingers against said latch-actuator means to advance said latch means against the action of said resilient means to disengage said latch means from said stop means and simultaneously to permit said hand-lever to move simultaneously against and to operate said palm switch to cycle said machine.

17. An actuator-guard as defined by claim 16 including pin-and-slot means interconnecting said latch means and said hand-lever permitting limited sliding movement of said latch means into and out of engagement with said stop means.

18. An actuator-guard for palm switches as defined by claims 17 wherein laterally spaced portions of said latch means are disposed at opposite sides of said hand-lever.

19. An actuator-guard for palm switches as defined by claim 18, wherein said pin-and-slot means are provided at and associated with each of the laterally spaced portions of said latch means.

20. An actuator-guard for palm switch as defined by claim 19, wherein said pin-and-slot means are disposed in and associated with each of said laterally spaced portions of said latch means and comprises at least two longitudinally spaced slots and a pin moveable in each of said slots.

21. An actuator-guard for palm switches disposed as defined by claim 20, including longitudinal ways disposed in the laterally spaced portions of said guide means; and wherein said fixed stop means are carried by said frame and are cooperative with said ways during sliding movement of said latch means to guide the latch means and to limit lateral movement of said hand-lever in use.

22. An activator-guard for palm switches as defined by claim 21, wherein said ways are disposed intermediate said longitudinally spaced slots.

23. An actuator-guard for palm switches as defined by claim 22, including seat means on said stop members engageable with said latch means only in the stop-engaging position of the latter and during initial forward movement thereof by said latch-actuator means.

24. An actuator-guard for palm switches as defined by claim 23, including guide members on said stop members adjacent to said seat means coactive with said ways to limit retroactive movement of said latch means and to control sliding movement of said latch means for the entire forward movement of said latch means and during pivotal movement of said hand-lever to and from said palm switch.

25. An actuator-guard as defined by claim 16, wherein said frame comprises an opening through which the palm switch extends when said frame is mounted on said machine;

said frame is provided with upstanding flanges at opposite sides of said opening said hand-lever; said hand-lever is pivotally attached to said flanges; and said stop means comprises a pair of stop members on the frame at opposite sides of said adaptor means; said stop members being disposed for seating engagement with said hand-lever when the hand-lever is in the stop engaging position.

26. An actuator-guard as defined by claim 25 including guide means for guiding said hand-lever in its pivoted movement and for limiting lateral movement thereof during said pivoted movement.

* * * * *